United States Patent [19]

Watson et al.

[11] 4,124,989

[45] Nov. 14, 1978

[54] SUPPORTS FOR MARITIME STRUCTURES

[75] Inventors: Donald M. Watson, Leven, Scotland; Vladimir Nastasić, Zapresic, Yugoslavia

[73] Assignee: Redpath Dorman Long (North Sea) Limited, Bedford, England

[21] Appl. No.: 692,733

[22] Filed: Jun. 4, 1976

[30] Foreign Application Priority Data

Jun. 4, 1975 [GB] United Kingdom ..... 24139/75

[51] Int. Cl.[2] ..... E02D 27/52

[52] U.S. Cl. ..... 405/225; 405/226

[58] Field of Search ..... 61/99, 98, 87, 97, 96, 61/69 R, 50; 175/9, 7; 166/5

[56] References Cited

U.S. PATENT DOCUMENTS

| | | | |
|---|---|---|---|
| 3,475,915 | 11/1969 | Caplan | 61/69 R |
| 3,552,903 | 1/1971 | Townsend, Jr. | 175/7 |
| 3,613,381 | 10/1971 | Cox | 61/87 |
| 3,896,628 | 7/1975 | Hansen | 61/99 |
| 3,906,735 | 9/1975 | Mo | 61/99 |
| 3,928,982 | 12/1975 | Lacroix | 61/99 |

*Primary Examiner*—Jacob Shapiro
*Attorney, Agent, or Firm*—Bacon & Thomas

[57] ABSTRACT

A shear key unit for attachment rigidly to the base of a foundation raft for a maritime structure comprises an open ended thin walled cylinder, which when its open end is facing downwardly beneath the raft, acts as a fluid tight chamber of variable volume - the volume being diminished as the cylinder penetrates the seabed strata. The foundation raft can be lowered by controllably allowing sea water to escape from the chamber. A slidable closure may be provided at the distal end of the cylinder to isolate the interior of the cylinder from the seabed. It is a feature of the invention that the cylinder assembly can be installed through an opening extending downwardly through the foundation raft, and can thereafter be fixed in a position projecting beneath the base of the raft. A method of installing and attaching the shear key upon the slab is disclosed, and involves lowering the cylinder assembly through openings in the slab after the raft has been floated out, then fixing the cylinder assemblies in positions within the openings with the cylinders projecting beneath the slabs.

7 Claims, 5 Drawing Figures

SUPPORTS FOR MARITIME STRUCTURES

Figure 1:
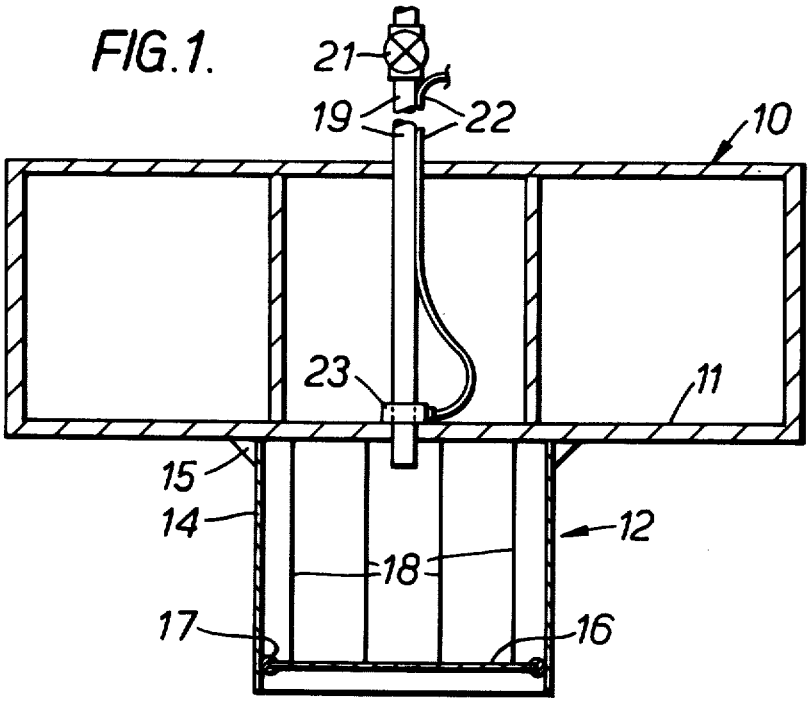

The invention relates to support means for the base of a foundation raft such as may be used for a maritime platform, intended for the drilling for, or the production of, hydrocarbon fuels, or for telecommunications or military purposes.

It has been suggested to provide such a base with hollow and downwardly open columns having means for the reduction of hydrostatic pressure therein. The intention of the prior art configuration is to reduce the hydrostatic pressure within the columns by continuously pumping out water seeping through the seabed strata so that the pressure differential will cause the columns to be pressed firmly down into the seabed.

In U.S. Pat. No. 3,896,628, owned in common with this invention, a shear key unit slidably attached to the base of a foundation raft is described, the unit including an open ended downwardly facing chamber, particulate means in the chamber, movable closure means arranged to alter the capacity of the chamber, and means to move particulate material from the chamber to an adjacent attached container.

The present invention is concerned with the provision of a readily controllable liquid support in such a unit from which liquid could be allowed to escape to ambient, so to provide land on the seabed such as is absent from the first prior art proposal, while avoiding the need to handle particulate material at seabed level as has been proposed in the patent identified above. In addition, this invention enables the cylinder to be rigidly connected to the raft slab while permitting its level of penetration in the seabed or subaqueous surface to vary.

The invention provides a shear key unit rigidly attached to or for attachment to the base of a foundation raft, and comprising a liquid tight chamber of variable volume within a cylinder which is open at its bottom to pressure transmitted from the seabed to the base, and means to control the escape of a liquid or other incompressible flowable medium from that chamber, whereby the foundation raft may be lowered towards the seabed.

It is preferred that there is means whereby the shear key unit can be lowered from or through the raft to a position in which it projects below the base, and can then be rigidly fixed in that position.

It is further preferred that said means or other means can temporarily support the unit within the raft.

The said means may be detent in the unit arranged for engagement with a latch attached to the raft.

It is also preferred that said means is an outstanding radial projections, whereby the unit can be supported by part of the raft.

It is further preferred that the projection is a peripheral flange, and is adapted to seat on a part of a base slab surrounding an aperture in the base of the raft.

Conveniently the means to allow the escape of fluid is a valve in an outlet conduit extending upwardly from the chamber.

Advantageously there is means to withdraw fluid from the conduit or the chamber, whereby the foundation raft may be moved downwardly towards or into the seabed by the reduction of pressure within the chamber.

In one form the means to withdraw fluid from the chamber may be a submersible pump located in or near the chamber.

In another form the means to withdraw fluid from the chamber may comprise a high pressure air supply arranged to discharge near the base of a conduit leading upwardly from the chamber.

In this form it is preferred that the discharge is effected through the perforated annulus surrounding the conduit.

The bottom of the chamber may have a closure plate which rests on the seabed, and the remainder of the chamber is downwardly open, such that the plate can retract in to it as fluid escapes therefrom.

The plate may be suspended by chains from the top of the chamber.

The invention includes a foundation raft having at least three units as described above, in which there is an open cell in the foundation raft for each unit, whereby the units can be lowered into the foundation raft for attachment thereto in positions projecting below the base surface thereof.

The invention also provides a method of lowering a foundation raft towards the seabed which comprises the steps of attaching a unit to the base of the raft, which unit has a fluid tight chamber, and then controlling the escape of fluid from that chamber, whereby the foundation raft may be lowered towards the seabed.

Preferably the unit is fabricated as a thin walled open ended chamber, is then lowered open end downward in to an aperture extending vertically through the raft, and is then fixed to the raft so that it projects beneath the base thereof.

Advantageously the unit can be temporarily supported within the raft before the lowering is completed.

Figure 2:
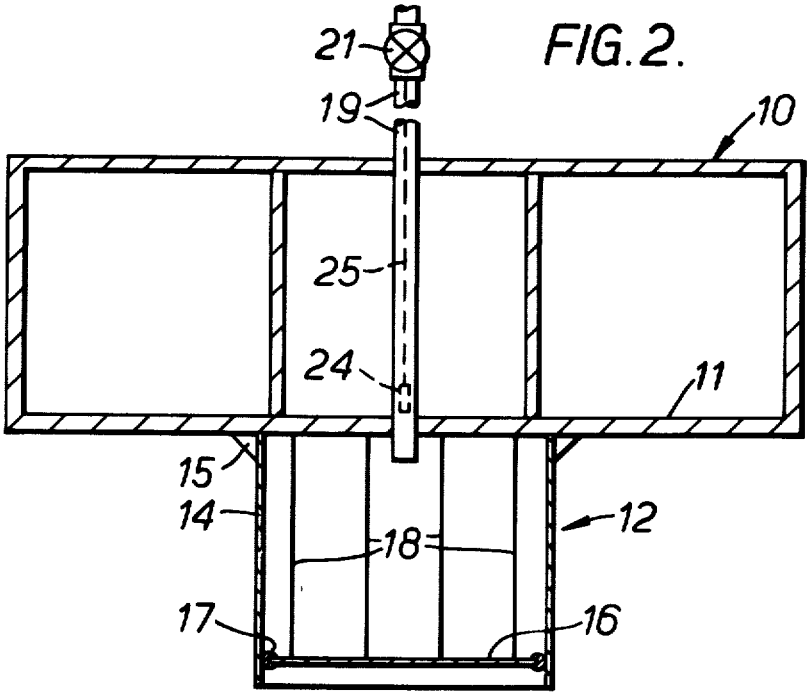
Figure 3:
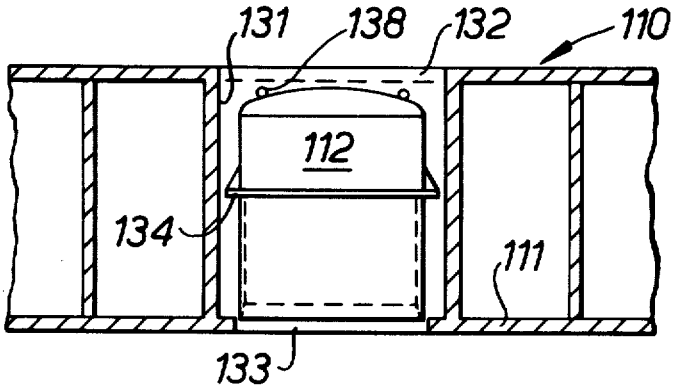
Figure 4:
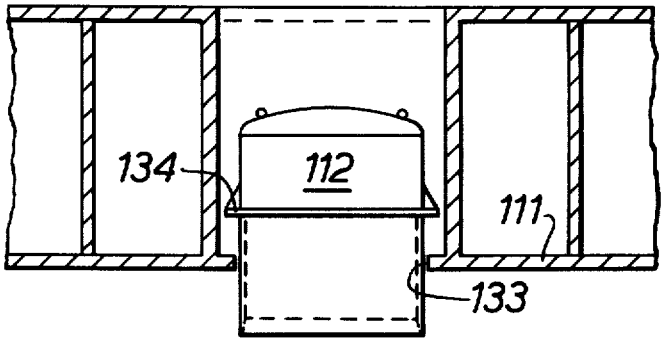
Figure 5:
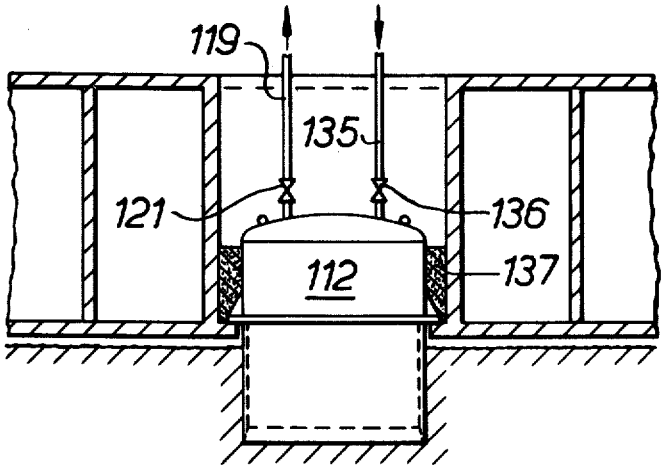

Three specific embodiments of the invention will now be described by way of example with reference to the accompanying drawings, in which:

FIGS. 1 and 2 show respectively sections of two slightly different units attached to the base of a foundation raft, FIG. 3 shows a section through part of a foundation raft with a unit according to the invention suspended therein, FIG. 4 shows the same part, with the unit partially lowered, and FIG. 5 shows the same part, with the unit lowered, and the raft resting on a seabed.

As shown in both FIGS. 1 and 2 a foundation raft 10 has a base slab 11, and depending downwardly therefrom there is a shear key unit 12. The unit 12 comprises a peripheral steel cylinder wall 14 rigidly attached to the base slab 11 by brackets 15, and at or near the open bottom or distal end of the cylinder 14 there is a plate closure or diaphragm 16 in sealing engagement with the wall 14 by means of an annular seal 17. The space enclosed by the base slab 11, the peripheral wall 14 and the closure 16 constitutes a fluid tight chamber. The plate 16 is shown supported from the base slab 11 by means of chains 18. The chamber is normally filled with liquid such as seawater, or may be filled with another incompressible flowable medium.

Following the invention there is an upwardly leading conduit 19 communicating with the fluid tight chamber. The conduit is closed by a valve 21 at or near the surface of water above the foundation raft, which valve may be selectively opened to allow the controlled escape of water from the otherwise fluid tight chamber.

It will be appreciated that all these features are common to the two embodiments of the invention shown in FIGS. 1 and 2 of the accompanying drawings.

As shown specifically in FIG. 1 there is a high pressure air line 22 extending from the surface to an annulus or manifold 23 surrounding the conduit 19 just above the lower slab 11. The walls of the conduit are preforated where the annulus surrounds it to admit high pressure air, which may be pumped down the lie 22 to entrain and displace water as it escapes upwardly through the conduit 19, so reducing the water pressure in the fluid tight chamber. In this way the peripheral wall 14 can be driven into the subsea strata.

As shown specifically in FIG. 2 the air lift pump is replaced by a conventional submersible pump 24 which acts in a similar way. The pump 24 is supported on an armoured cable 25.

An additional pump (not shown) may be arranged to withdraw water from a position below the intended sea level, but near to the top of the conduit 19.

In use, the foundation raft is founded on the seabed so that it rests on at least three of the units 12 described above. The water in the chambers now acts as a support between the seabed and the slab 11 supporting the foundation raft. The attitude of the raft can now be adjusted — in a case when the raft has been founded on uneven terrain — by controlling the escape of water from the chambers.

To encourage the escape of water from the chamber, the head of water in the upwardly leading conduit or riser 19 can be reduced by pumping. This reduces the effective pressure within the chambers, so allowing the units to sink into the seabed.

If it is necessary to force the units downwardly to ensure penetration of the walls 16 into the subsea strata, water in the fluid tight chambers may be deliberately withdrawn, rather than merely allowed to escape.

In the embodiment of the invention shown in FIGS. 3 to 5 a foundation raft 110 has a base slab 111 and a shear key unit 112. The raft has a hollow cell 131 which is open top and bottom, but the tip opening 132 is larger than the opening 133 in the slab 111. The unit 112 is a cylindrical steel shell with a closed upper end (constituting a fluid tight chamber) and has an outstanding flange 134. The unit has lifting trunnions 138. The diameter and the depth of the unit intended to penetrate the seabed are variables which can be altered to suit the strength of the seabed strata. The thickness of the shell is designed to resist local buckling. The surface of the unit may be coated with low friction material, and high pressure jets may be fitted at the toe to assist penetration. The diameters of the opening 133 and flange 134 are such that when the unit is lowered from its position in FIG. 3 to its position in FIG. 4, the flange 134 rests on the part of the slab 111 surrounding the opening 133.

An upwardly leading conduit 119 is connected to the top of the unit 112, and has a remotely operated valve 121 to allow and control the escape of water from the unit. An extra conduit 135, with a valve 136 allows sand or grout to be introduced to fill the unit after founding.

In use, the foundation raft 110 is constructed with at least three (and typically eight) hollow open cells 131. When the seabed characteristics are accurately known, units 112 are designed, fabricated and installed as shown in FIG. 3. An advantage of this scheme is that the long lead time item (the foundation raft) can be designed and at least partially completed before the detailed requirements for the units 112 are known. Also the foundation raft can have a shallow draft for initial float out, since the units 112 can be installed after such float out. The unit 112 is lowered as shown in FIG. 4 until the flange 134 rests on the base slab 111. Concrete 137 is then placed in the annular space between the unit and the cell 131, so to fix the unit encastre to the underside of the raft as shown in FIG. 5.

If appropriate the unit can be fixed permanently in the position shown in FIG. 4 by placing concrete above and below the flange 134 as shown in dotted lines.

The raft is then submerged and founded on the seabed in the manner described with respect to FIGS. 1 and 2. When he raft is in its intended position, the space within the unit can, if desired, be filled with sand or grout fed down the conduit 135, while the water displaced thereby is allowed to escape up the conduit 119. Any gap between the seabed and the base slab 111 can be back filled with sand or grout if necessary.

We claim:

1. In a foundation raft for a free-standing maritime platform, the raft including a horizontal base slab from which depends a plurality of shear key units adapted to engage and penetrate a subaqueous bed, an improved shear key unit comprising:

a fluid tight cylinder having a distal end open to pressure from the subaqueous bed;

means for charging the interior of the cylinder with a liquid;

means for selectively and controllably enabling the exhausting of liquid from the interior of the cylinder to ambient;

said cylinder being a separate assembly from the slab;

said slab including open cells for accommodating and supporting each of the shear key units, each cell extending through the slab and being dimensioned so that a cylinder assembly can be lowered into the respective cell from the top of the slab; and means for rigily securing each respective cylinder to the slab while it is within a cell and extends below the slab a predetermined amount.

2. The invention recited in claim 1, wherein said pump comprises a compressed air liquid displacement pump, including a compressed air inlet manifold attached to the conduit adjacent the chamber, and means for supplying compressed air to the manifold.

3. The invention recited in claim 1, including means within each cell recited in claim 1, including means within each cell and on each cylinder assembly arranged to cooperated with each other in a manner to positively limit the downward travel of the cylinder assembly in the cell.

4. The invention recited in claim 3, including radial projections in the cell and on the cylinder assembly, said projections being engageable with each other for limiting the downward travel of the cylinder assembly.

5. The invention recited in claim 1, the liquid exhausting enabling means comprising a conduit secured to the cylinder and in communication with the chamber, and a selectively controllable valve for regulating exhausting of liquid from the chamber to ambient.

6. A method of installing and attaching vertical shear units upon a horizontal base slab of a foundation raft for a maritime platform assembly, the shear key units comprising fluid tight vertical cylinder assemblies open at their bottoms and adapted to engage and penetrate a subaqueous bed, the cylinders defining variable volume liquid chambers including means to control the escape of liquid normally filling the chambers comprising (a) constructing the base slab with an open vertical cell extending through the slab at each location where a shear key unit is to be installed, each cell being dimensioned to accommodate a respective cylinder assembly within the cell;

(b) floating the slab;

(c) lowering a cylinder assembly into each cell so that it projects vertically from the bottom of the slab a desired amount;

(d) rigidly fixing the cylinder assembly relative to the slab within its respective cell.

7. The invention recited in claim 6, including placing a settable compound between each cylinder assembly and the sidewalls of each cell, whereby, upon the compound setting, the cylinder assembly is rigidly fixed relative to the slab and is capable of transmitting lateral and vertical forces between the slab and the subaqueous bed.

* * * * *